US005688554A

United States Patent [19]

Nakaoka et al.

[11] Patent Number: 5,688,554

[45] Date of Patent: Nov. 18, 1997

[54] METHOD OF SIZING CARBON FIBERS

[75] Inventors: Yoshihiko Nakaoka; Osamu Makino, both of Aichi, Japan

[73] Assignee: Takemoto Yushi Kabushiki Kaisha, Japan

[21] Appl. No.: 677,964

[22] Filed: Jul. 10, 1996

[30] Foreign Application Priority Data

Jul. 17, 1995 [JP] Japan ..... 7-203848

[51] Int. Cl.[6] ..... B05D 7/00

[52] U.S. Cl. ..... 427/215; 427/220; 427/384

[58] Field of Search ..... 427/577, 113, 427/112, 215, 220, 384

*Primary Examiner*—Bernard Pianalto

*Attorney, Agent, or Firm*—Majestic, Parsons, Siebert & Hsue

[57] ABSTRACT

A sizing agent is prepared from at least one specified kind of ester and at least one specified polyepoxy compound. A water-based sizing agent is prepared by emulsifying or dispersing it in water and is applied to carbon fibers at a specified ratio as sizing agent to improve lubricity, abrasion durability and spreadability of the carbon fibers at the same time.

9 Claims, No Drawings

METHOD OF SIZING CARBON FIBERS

BACKGROUND OF THE INVENTION

This invention relates to a method of sizing carbon fibers.

Composites with carbon fibers are widely utilized in the fields of sports, leisure and aerospace technologies. Carbon fibers are usually produced in the form of filaments or tows and fabricated into unidirectionally roved sheets, tapes, filament windings, cloth or chopped fibers to be used. During these fabrication processes, carbon fibers come into contact repetitively with various guide members and are subjected to frictional forces. Carbon fibers are therefore required to have not only lubricity but also the property of not generating fluffs or filament breakage due to repetitive contacts or friction (hereinafter referred to as the abrasion durability). In order to obtain high-quality fabricated products, carbon fibers are further required to have the capability of easily spreading thinly without gaps even with a weak contact pressure (hereinafter referred to as the spreadability). It now goes without saying that carbon fibers are additionally required not to adversely affect the favorable physical properties such as interlaminar shear strength of the composite for the production of which they are used. It is an object of this invention to provide a method of sizing carbon fibers which can respond to all such requirements.

According to a prior art method of sizing carbon fibers, a sizing agent is emulsified or dispersed in water and the water-based emulsion of the sizing agent thus obtained is applied to the carbon fibers. Examples of such prior art method include: (1) using together phenol-based or aromatic amine-based epoxy compound and either oleic acid ester of aliphatic monohydric alcohol or aliphatic monohydric acid ester of oleyl alcohol (as disclosed in Japanese Patent Publication Tokkai 62-56267, U.S. Pat. No. 4,751,258); and (2) using together aliphatic monocarboxylic acid ester of monohydric compound and a non-ionic surfactant (as disclosed in Japanese Patent Publication Tokkai 6-10264). Prior art method (1) described above can provide a certain level of lubricity to carbon fibers but cannot provide sufficient abrasion durability or spreadability. Prior art method (2) described above can provide sufficient abrasion durability and spreadability but, when such carbon fibers are used to produce a composite, and especially when epoxy resin is used as matrix resin, the interlaminar shear strength of the produced composite becomes weaker.

It is therefore a specific object of this invention to overcome the problems of prior art sizing methods that they cannot provide sufficient lubricity, abrasion durability and spreadability to carbon fibers at the same time or that they affect adversely the physical properties of the composite produced therewith.

SUMMARY OF THE INVENTION

The present invention is based on the discovery by the present inventors that desired results can be obtained if use is made of a sizing agent obtained by mixing at least one ester of a specified kind and at least one polyepoxy compound of a specified kind at a specified ratio and to apply a specified amount of this agent as a water-based sizing agent to carbon fibers.

DETAILED DESCRIPTION OF THE INVENTION

This invention relates to a method of sizing carbon fibers, characterized in preparing a water-based sizing agent by emulsifying or dispersing in water a sizing agent comprising at least one ester of the kind described below and at least one polyepoxy compound having two or more epoxy groups in the molecule at weight ratio of 2/98–16/84 and applying this water-based sizing agent to carbon fibers at a rate of 0.1–5.0 weight % as the sizing agent. The aforementioned at least one ester according to this invention is characterized as including at least one kind selected from Group A, Group B and Group C where Group A consists of esters obtained by esterifying completely aliphatic dihydric-hexahydric alcohol having 2–20 carbon atoms with aliphatic monocarboxylic acid having 6–26 carbon atoms and containing 50–95 molar % of aliphatic monoenic monocarboxylic acid, Group B consists of esters obtained by esterifying completely aliphatic dihydric-hexahydric (poly)etherpolyol with aliphatic monocarboxylic acid having 6–26 carbon atoms and containing 50–95 molar % of monoenic monocarboxylic acid, and Group C consists of esters obtained by esterifying completely aliphatic monohydric alcohol having 6–26 carbon atoms and containing 50–95 molar % of unsaturated aliphatic alcohol with aliphatic dicarboxylic-hexacarboxylic acid having 2–20 carbon atoms.

More in detail, esters of Group A which may be used according to this invention are esters of aliphatic monocarboxylic acid with 6–26 carbon atoms, of which 50–95 molar %, preferably 60–90 molar %, and more preferably 70–85 molar % is aliphatic monoenic monocarboxylic acid, and aliphatic dihydric-hexahydric alcohol having 2–20 carbon atoms.

Examples of aforementioned aliphatic monocarboxylic acid include various well known kinds of saturated aliphatic monocarboxylic acid, aliphatic monoenic acid and aliphatic polyenic acid but 50–95 molar %, preferably 60–90 molar %, and more preferably 70–85 molar % of which is aliphatic monoenic acid. Examples of such aliphatic monoenic monocarboxylic acid include various known kinds of aliphatic monoenic monocarboxylic acid but aliphatic monoenic acids with 14–22 carbon atoms such as myristoleic acid, palmitoleic acid, oleic acid and erucic acid are preferred. Among aliphatic monocarboxylic acids other than aliphatic monoenic monocarboxylic acid, saturated aliphatic monocarboxylic acids with 12–18 carbon atoms and aliphatic dienic monocarboxylic acids are preferred.

Examples of aforementioned polyhydric alcohol include: (1) aliphatic dihydric alcohols such as ethylene glycol, propylene glycol, butylene glycol, 1,6-hexane diol, hexadecane-1,2-diol, and octadecane-1,2-diol; (2) aliphatic trihydric alcohols such as glycerine, trimethylol ethane and trimethylol propane; and (3) aliphatic tetrahydric or hexahydric alcohols such as pentaerythritol and sorbitol, but aliphatic dihydrictetrahydric alcohols are preferred.

Esters of Group B according to this invention are esters of aliphatic monocarboxylic acid with 6–26 carbon atoms, of which 50–95 molar %, preferably 60–90 molar %, and more preferably 70–85 molar % is aliphatic monoenic monocarboxylic acid, and dihydric-hexahydric (poly)ether polyol.

Examples of aforementioned aliphatic monocarboxylic acid are as described above regarding esters of Group A. Examples of aforementioned (poly)ether polyol include: (1) dihydric-hexahydric ether polyols such as diethylene glycol, dipropylene glycol, diglycerine and dipentaerythritol; and (2) dihydric-hexahydric polyether polyols obtained by adding alkylene oxide with 2–3 carbon atoms to dihydric-hexahydric aliphatic alcohol described above regarding esters of Group A. Among these, however, dihydric-tetrahydric (poly)ether polyols are preferred and those (poly)

ether polyols with molecular weight 40–130 per hydroxyl group in the molecule are even more preferred.

Esters of Group C according to this invention are esters of aliphatic monohydric alcohol with 6–26 carbon atoms, of which 50–95 molar %, preferably 60–90 molar %, and more preferably 70–85 molar % is unsaturated aliphatic alcohol, and aliphatic dihydric-hexahydric acid with 2–20 carbon atoms.

Examples of aforementioned aliphatic monohydric alcohol include various well known saturated and unsaturated aliphatic alcohols, of which 50–95 molar %, preferably 60–90 molar %, and more preferably 70–85 molar % is unsaturated aliphatic alcohol. Examples of such unsaturated aliphatic alcohol include: (1) alkane monoenols such as hexadecenyl alcohol, oleyl alcohol and eicosenyl alcohol; and (2) alkane dienols and alkane trienols such as octadeca dienol, octadeca trienol and eicosa trienol. Among the above, alkane monoenols with 16–20 carbon atoms are preferred. Among aliphatic monohydric alcohols other than unsaturated aliphatic alcohols, saturated aliphatic monohydric alcohols with 12–18 carbon atoms are preferred.

Examples of aforementioned aliphatic dicarboxylic-hexacarbolic acid include: (1) saturated aliphatic dibasic acids such as oxalic acid, succinic acid, adipic acid, cebasic acid and octadecane dicarboxylic acid; (2) saturated aliphatic polybasic acids such as 1,2,3-propane tricarboxylic acid, 1,2,3,4-butane tetracarboxylic acid and 1,2,3,4,5,6-hexane hexacarboxylic acid; and (3) unsaturated aliphatic dibasic acids such as maleic acid, fumaric acid and dodecenyl succinic acid. Among the above, saturated aliphatic dicarboxylic-tetracarboxylic acids with 4–8 carbon atoms are preferred.

The polyepoxy compound to be used according to this invention is one having two or more epoxy groups in the molecule. Examples of such polyepoxy compounds include various known kinds of polyepoxy compounds, but preferable among them are: (1) phenol based polyepoxy compounds such as bisphenol A diglycidylether, bisphenol F diglycidylether, resorcinol diglycidylether, and polymethylene polyphenyl glycidylether; (2) epoxydized polyalkadienes with alkadiene having 4–6 carbon atoms such as epoxydized polybutadiene and epoxydized polyisoprene; and (3) epoxydized unsaturated fatty acid triglycerides such as epoxydized soybean oil and epoxydized rape seed oil.

As explained above, the sizing agent to be used according to this invention comprises an ester component and polyepoxy compound at weight ratio of 2/98–16/84, and preferably 4/96–14/86. According to this invention, such a sizing agent is emulsified or dispersed in water to form a water-based sizing agent, and the water-based sizing agent thus prepared is caused to adhere to carbon fibers. For the preparation of such a water-based sizing agent, it is preferable to use a non-ionic surfactant in order to enable the sizing agent to cover the surface of the carbon fibers uniformly as minute, stable and uniform emulsified or dispersed particles. For this purpose, less than 45 weight parts, and preferably 5–30 weight parts, of the surfactant is used per 100 weight parts of the sizing agent formed with an ester component and a polyepoxy compound.

Examples of non-ionic surfactant to be used as above include: (1) polyoxyethylene substituted phenylethers having phenyl group substituted with hydrocarbon group such as polyoxyethylene alkylphenylether, polyoxyethylene (poly)styrylphenyl-ether and polyoxyethylene (poly) benzylphenyl; and (2) formalin condensation products of polyoxyethylene substituted phenylether of (1) such as formalin condensation product of polyoxyethylene styrylphenyl-ether and formalin condensation product of poly-oxyethylene benzylphenylether. In all cases, the repetition number of oxyethylene unit may be selected appropriately for providing desired emulsifying and dispersion characteristics to the water-based sizing agent to be prepared.

The water-based sizing agent can be prepared by a known mechanical method using a homo-mixer or a homogenizer. For example, it can be by a so-called emulsification method by phase inversion whereby the ester component and the polyepoxy compound, and preferably a non-ionic surfactant, are mixed together uniformly, and, after it is heated and dissolved, if necessary, water is gradually added to this mixture or solution. Normally, the water-based sizing agent is prepared such that the density of the sizing agent consisting only of an ester component and a polyepoxy compound will be 10–50 weight % and, when it is actually used on carbon fibers, water is added further such that the ratio of the sizing agent will be 0.1–10 weight %.

This invention does not impose any limitation on the size of the emulsified or dispersed particles in the water-based sizing agent but the preferred particle size is 0.1–0.2 μm. A desired particle size can be obtained by appropriately selecting the kind of the non-ionic surfactant and the method of emulsifying or dispersing when the water-based sizing agent is prepared.

The rate at which the water-based sizing agent is to be used is such that the amount of the sizing agent attached to the carbon fibers will be 0.1–5.0 weight %, and preferably 0.5–3.0 weight % of the carbon fibers. Prior art methods of application such as the roller dipping method and the spray method may be used.

The present invention can be applied to PAN or pitch-based carbon fibers but is particularly effective on carbon fiber bundles with filament count greater than 500. According to the present invention, the sizing agent can cover the surface of carbon fibers uniformly such that the carbon fibers obtain superior lubricity, abrasion durability and spreadability at the same time. The present invention is also capable of improving physical characteristics of the composites using such carbon fibers.

The following sixteen methods are described as examples of preferred methods according to this invention.

(1) Ester of a mixture of palmitolic acid and stearic acid, of which 90 molar % is palmitolic acid, and ethylene glycol is mixed with a mixture of bisphenol A diglycidylether (epoxy equivalent 190) and epoxydized 1,2-polybutadiene (epoxy equivalent 500) at weight ratio of 6/94 to prepare a sizing agent. Polyoxyethylene (25 mole) tribenzyl phenylether (15 weight parts) is used to emulsify 100 weight parts of this sizing agent in water. The water-based sizing agent thus obtained is applied by the roller dipping method to PAN type carbon fibers with filament count 12000 such that the sizing agent will be 1.0 weight % of the carbon fibers.

(2) The water-based sizing agent described in (1) is applied by the spray method to pitch-based carbon fibers with filament count 5000 such that the sizing agent will be 1.0 weight % of the carbon fibers.

(3) Ester of a mixture of oleic acid and stearic acid, of which 75 molar % is oleic acid, and pentaerythritol is mixed with a mixture of bisphenol A diglycidylether (epoxy equivalent 190) and polymethylene polyphenylglycidylether (epoxy equivalent 170) at weight ratio of 12/88 to prepare a sizing agent. A mixture of polyoxyethylene (10 mole) nonylphenylether and polyoxyethylene (35 mole) tribenzylphenylether (25 weight parts) is used to emulsify 100 weight parts of this sizing agent in water. The water-based sizing agent thus obtained is applied by the roller dipping method to PAN type carbon fibers with filament count 12000 such that the sizing agent will be 1.0 weight % of the carbon fibers.

(4) The water-based sizing agent described in (3) is applied by the spray method to pitch-based carbon fibers with filament count 5000 such that the sizing agent will be 0.5 weight % of the carbon fibers.

(5) The water-based sizing agent described in (4) is applied by the roller dipping method to PAN type carbon fibers with filament count 12000 such that the sizing agent will be 2.0 weight % of the carbon fibers.

(6) The water-based sizing agent described in (4) is applied by the spray method to pitch-based carbon fibers with filament count 5000 such that the sizing agent will be 2.0 weight % of the carbon fibers.

(7) Ester of a mixture of oleic acid and palmitic acid, of which 90 molar % is oleic acid, and diethylene glycol is mixed with a mixture of bisphenol A diglycidylether (epoxy equivalent 190) and bisphenol A diglycidylether (epoxy equivalent 650) at weight ratio of 4/96 to prepare a sizing agent. A mixture of polyoxyethylene (10 mole) nonylphenylether and polyoxyethylene (25 mole) tribenzylphenylether (25 weight parts) is used to emulsify 100 weight parts of this sizing agent, and the water-based sizing agent thus obtained is applied by the roller dipping method to PAN type carbon fibers with filament count 12000 such that the sizing agent will be 1.5 weight % of the carbon fibers.

(8) The water-based sizing agent described in (7) is applied by the spray method to pitch-based carbon fibers with filament count 5000 such that the sizing agent will be 1.5 weight % of the carbon fibers.

(9) Ester of a mixture of oleic acid and lauric acid, of which 75 molar % is oleic acid, and diglycerine is mixed with a mixture of bisphenol A diglycidylether (epoxy equivalent 190) and polymethylene polyphenylglycidylether (epoxy equivalent 170) at weight ratio of 8/92 to prepare a sizing agent. A mixture of polyoxyethylene (10 mole) nonylphenylether and polyoxyethylene (35 mole) tribenzylphenylether (25 weight parts) is used to emulsify 100 weight parts of this sizing agent, and the water-based sizing agent thus obtained is applied by the roller dipping method to PAN type carbon fibers with filament count 12000 such that the sizing agent will be 1.5 weight % of the carbon fibers.

(10) The water-based sizing agent described in (9) is applied by the spray method to pitch-based carbon fibers with filament count 5000 such that the sizing agent will be 1.5 weight % of the carbon fibers.

(11) Ester of a mixture of oleic acid and palmitic acid, of which 67 molar % is oleic acid, and triethoxylated glycerine is mixed with a mixture of bisphenol A diglycidylether (epoxy equivalent 190) and polymethylene polyphenylglycidylether (epoxy equivalent 170) at weight ratio of 12/88 to prepare a sizing agent. A mixture of polyoxyethylene (10 mole) nonylphenylether and polyoxyethylene (35 mole) tribenzylphenylether (10 weight parts) is used to emulsify 100 weight parts of this sizing agent, and the water-based sizing agent thus obtained is applied by the roller dipping method to PAN type carbon fibers with filament count 12000 such that the sizing agent will be 1.5 weight % of the carbon fibers.

(12) The water-based sizing agent described in (11) is applied by the spray method to pitch-based carbon fibers with filament count 5000 such that the sizing agent will be 1.5 weight % of the carbon fibers.

(13) Ester of a mixture of oleyl alcohol and lauryl alcohol, of which 90 molar % is oleyl alcohol, and succinic acid is mixed with a mixture of bisphenol A diglycidylether (epoxy equivalent 190) and bisphenol A diglycidylether (epoxy equivalent 450) at weight ratio of 6/94 to prepare a sizing agent. A mixture of polyoxyethylene (10 mole) nonylphenylether and polyoxyethylene (25 mole) tribenzylphenylether (25 weight parts) is used to emulsify 100 weight parts of this sizing agent, and the water-based sizing agent thus obtained is applied by the roller dipping method to PAN type carbon fibers with filament count 12000 such that the sizing agent will be 1.5 weight % of the carbon fibers.

(14) The water-based sizing agent described in (13) is applied by the spray method to pitch-based carbon fibers with filament count 5000 such that the sizing agent will be 1.5 weight % of the carbon fibers.

(15) Ester of a mixture of oleyl alcohol and stearyl alcohol, of which 75 molar % is oleyl alcohol, and 1,2,3,4-butane tetracarboxylic acid is mixed with a mixture of bisphenol A diglycidylether (epoxy equivalent 190) and bisphenol A diglycidylether (epoxy equivalent 450) at weight ratio of 12/88 to prepare a sizing agent. A mixture of polyoxyethylene (10 mole) nonylphenylether and polyoxyethylene (25 mole) tribenzylphenylether (25 weight parts) is used to emulsify 100 weight parts of this sizing agent, and the water-based sizing agent thus obtained is applied by the roller dipping method to PAN type carbon fibers with filament count 12000 such that the sizing agent will be 1.5 weight % of the carbon fibers.

(16) The water-based sizing agent described in (15) is applied by the spray method to pitch-based carbon fibers with filament count 5000 such that the sizing agent will be 1.5 weight % of the carbon fibers.

In what follows, the present invention is described further in detail with reference to test examples and comparison examples, but it goes without saying that these examples are not intended to limit the scope of the invention. In what follows, "parts" will mean "weight parts", and "%" will mean "weight %".

EXAMPLES

Part (1) (Preparation of Water-Based Sizing Agents)

Preparation of Water-Based Sizing Agent (S-1)

Ester (a-1) of ethylene glycol, palmitolic acid and stearic acid at molar ratio of 1/1.8/0.2 was prepared according to the method of synthesis described in Japanese Patent Publication Tokkai 6-10264. After 6 g of ester (a-1) thus obtained, 25 g of polyoxy compound ((e-1): bisphenol A diglycidylether with epoxy equivalent 190), 69 g of polyepoxy compound ((e-5): epoxydized 1,2-polybutadiene with epoxy equivalent 500), and 15 g of polyoxyethylene (25 mole) tribenzylphenylether were melted and mixed together at 90° C., the mixture was cooled to 40° C. Water (460 g) at 40° C. was added to this mixture to prepare water-based sizing agent (S-1).

Water-based sizing agents (S-2)-(S-7) and (R-1)-(R-15) were similarly prepared as shown in Tables 1 and 2.

TABLE 1

| Water-based sizing agent | Ester Kind | Ester Amount (Part) | Polyepoxy Compound Kind | Polyepoxy Compound Amount (Part) | Ratio (Weight Ratio) | Non-ionic Surfactant Kind | Non-ionic Surfactant Amount (Part) |
|---|---|---|---|---|---|---|---|
| S-1 | a-1 | 6 | e-1 | 25 | 6/94 | n-1 | 15 |
| | | | e-5 | 69 | | | |
| S-2 | a-2 | 12 | e-1 | 63 | 12/88 | n-3 | 20 |
| | | | e-4 | 25 | | n-2 | 5 |
| S-3 | b-1 | 4 | e-1 | 65 | 4/96 | n-1 | 19 |
| | | | e-3 | 31 | | n-2 | 6 |
| S-4 | b-2 | 8 | e-1 | 42 | 8/92 | n-3 | 20 |
| | | | e-4 | 50 | | n-2 | 5 |
| S-5 | b-3 | 12 | e-1 | 63 | 12/88 | n-3 | 5 |
| | | | e-4 | 25 | | n-2 | 5 |
| S-6 | c-1 | 6 | e-1 | 50 | 6/94 | n-1 | 19 |
| | | | e-2 | 44 | | n-2 | 6 |
| S-7 | c-2 | 12 | e-1 | 44 | 12/88 | n-1 | 20 |
| | | | e-2 | 44 | | n-2 | 5 |

TABLE 2

| Water-based sizing agent | Ester Kind | Ester Amount (Part) | Polyepoxy Compound Kind | Polyepoxy Compound Amount (Part) | Ratio (Weight Ratio) | Non-ionic Surfactant Kind | Non-ionic Surfactant Amount (Part) |
|---|---|---|---|---|---|---|---|
| R-1 | ar-1 | 6 | e-1 | 56 | 6/94 | n-1 | 15 |
| | | | e-2 | 38 | | | |
| R-2 | ar-2 | 6 | e-1 | 56 | 6/94 | n-3 | 20 |
| | | | e-2 | 38 | | n-2 | 5 |
| R-3 | ar-3 | 6 | e-1 | 58 | 6/94 | n-3 | 20 |
| | | | e-2 | 36 | | n-2 | 5 |
| R-4 | br-1 | 6 | e-1 | 56 | 6/94 | n-1 | 19 |
| | | | e-2 | 38 | | n-2 | 6 |
| R-5 | br-2 | 6 | e-1 | 56 | 6/94 | n-3 | 20 |
| | | | e-2 | 38 | | n-2 | 5 |
| R-6 | br-3 | 6 | e-1 | 56 | 6/94 | n-3 | 20 |
| | | | e-2 | 38 | | n-2 | 5 |
| R-7 | br-4 | 6 | e-1 | 56 | 6/94 | n-3 | 20 |
| | | | e-2 | 38 | | n-2 | 5 |
| R-8 | cr-1 | 6 | e-1 | 56 | 6/94 | n-1 | 19 |
| | | | e-2 | 38 | | n-2 | 5 |
| R-9 | cr-2 | 6 | e-1 | 56 | 6/94 | n-1 | 25 |
| | | | e-2 | 38 | | | |
| R-10 | cr-3 | 6 | e-1 | 56 | 6/94 | n-1 | 25 |
| | | | e-2 | 38 | | | |
| R-11 | r-1 | 6 | e-1 | 56 | 6/94 | n-1 | 15 |
| | | | e-2 | 38 | | | |
| R-12 | r-2 | 6 | e-1 | 56 | 6/94 | n-1 | 15 |
| | | | e-2 | 38 | | | |
| R-13 | r-3 | 100 | — | — | 100/0 | n-4 | 33 |
| | | | | | | n-5 | 33 |
| R-14 | a-1 | 1 | e-1 | 61 | 1/99 | n-1 | 15 |
| | | | e-5 | 38 | | | |
| R-15 | a-1 | 19 | e-1 | 43 | 19/81 | n-1 | 15 |
| | | | e-5 | 38 | | | |

In Tables 1 and 2:

a-1: Ester (90 molar %) of ethylene glycol, palmitolic acid and stearic acid at molar ratio of 1/1.8/0.2;

a-2: Ester (75 molar %) of pentaerythritol, oleic acid and stearic acid at molar ratio of 1/3/1;

ar-1: Ethylene glycol distearate (0 molar %);

ar-2: Ester (25 molar %) of pentaerythritol, lauric acid and oleic acid at molar ratio of 1/3/1;

ar-3: Ester (100 molar %) of pentaerythritol and oleic acid at molar ratio of 1/4;

b-1: Ester (90 molar %) of diethylene diglycol, oleic acid and palmitic acid at molar ratio of 1/1.8/0.2;

b-2: Ester (75 molar %) of diglycerine, oleic acid and lauric acid at molar ratio of 1/3/1;

b-3: Ester (67 molar %) of triethoxylated glycerine, oleic acid and palmitic acid at molar ratio of 1/2/1;

br-1: Diethylene diglycol distearate (0 molar %);

br-2: Ester (38 molar %) of diglycerine, oleic acid and stearic acid at molar ratio of 1/1.5/2.5;

br-3: Ester (100 molar %) of diglycerine and oleic acid at molar ratio of 1/4;

br-4: Ester (33 molar %) of triethoxylated glycerine, oleic acid and palmitic acid at molar ratio of 1/1/2;

c-1: Ester (90 molar %) of oleyl alcohol, lauryl alcohol and succinic acid at molar ratio of 1.8/0.2/1;

c-2: Ester (75 molar %) of oleyl alcohol, stearyl alcohol and 1,2,3,4-butane tetracarboxylic acid at molar ratio of 3/1/1;

cr-1: Distearyl succinate (0 molar %);

cr-2: Ester (38 molar %) of olelyl alcohol, stearyl alcohol and 1,2,3,4-butane tetracarboxylic acid at molar ratio of 1.5/2.5/1;

cr-3: Ester (100 molar %) of oleyl alcohol and 1,2,3,4-butane tetracarboxylic acid at molar ratio of 4/1;

r-1: Oleyl stearate;

r-2: Oleyl oleate;

r-3: Ester of polyoxy ethylene (5 mole) glycol oleylether and palmitolic acid at molar ratio of 1/1;

(In the above, the molar % represents the ratio of aliphatic monoenic acid in aliphatic monocarboxylic acid in the case of ester corresponding to Group A or Group B, and the ratio of unsaturated aliphatic alcohol in aliphatic monohydric alcohol in the case of ester corresponding to Group C.)

e-1: Bisphenol A diglycidylether (epoxy equivalent 190: Epicote 828, produced by Yuka Shell Epoxy, Inc.);

e-2: Bisphenol A diglycidylether (epoxy equivalent 450: Epicote 1001, produced by Yuka Shell Epoxy, Inc.);

e-3: Bisphenol A diglycidylether (epoxy equivalent 650: Epicote 1002, produced by Yuka Shell Epoxy, Inc.);

e-4: polymethylene polyphenylglycidylether (epoxy equivalent 170: Epicote 152 produced by Yuka Shell Epoxy, Inc.);

e-5: Epoxydized 1,2-polybutadiene (epoxy equivalent 500: BF-1000 produced by Adeka Argus Chem. Corp.);

n-1: Polyoxyethylene (25 mole) tribenzylphenylether;

n-2: Polyoxyethylene (10 mole) nonylphenylether;

n-3: Polyoxyethylene (35 mole) tribenzylphenylether;

n-4: Polyoxyethylene (10 mole)/polyoxypropylene (2 mole) random adduct of castor oil;

n-5: Polyoxyethylene (16 mole)/polyoxypropylene (4 mole) block adduct of laurylether

Part (2) (Sizing of Carbon Fibers and Evaluations)

Sizing of Carbon Fibers

Each of the water-based sizing agents prepared in Part (1) was diluted with water according to the desired rate of attachment of the sizing agent and placed in a processing tank. Unsized carbon fibers obtained from polyacrylonitril fibers (with tensile strength 360 kg/mm$^2$, tensile modulus 23.5 t/mm$^2$, and filament count 12000) were successively dipped in the processing tank, and the desired amount of the sizing agent was applied by adjusting the squeezing condition on the rollers. They were dried successively in an over at 120° C. for 5 minutes.

Evaluation of Abrasion Durability ((*) in Table 3)

A TM type yarn friction and rubbing tester produced by Daiei Kagaku Seiki Kabushiki Kaisha was used to cause a chromium-plated metal piece to undergo a reciprocating motion 200 times at the rate of 150 times/minute. The friction between the metal and the carbon fibers was thus tested and the appearance of fluffs and yarn breakage was evaluated by the 5-point method according to the following standards:

5: Fluffs are not present;

4: Fluffs are somewhat present;

3: Fluffs are present;

2: There are many fluffs and there is yarn breakage;

1: Yarn breakage.

The results are shown in Table 3.

Evaluation of spreadability ((**) in Table 3)

A center part of sized carbon fibers of length 15 cm was clamped from two directions by clips with width 15 mm and the value of resistance (g) was continuously measured as the fibers were spread at the speed of 7 cm/minute in a direction perpendicular to the direction of the length. The maximum measured value was recorded as the force of spread resistance (g). If the spread resistance is 1–10g, spreadability is considered sufficient. The results are shown in Table 3.

Measurement of Interlaminar Shear Strength (ILSS)

Thermosetting (at 120° C.) Epoxy resin coating paper was used to produce by the dry method unidirectional prepreg sheets with sized carbon fibers at the rate of 100 g/m$^2$ and resin content 33%. These prepreg sheets were stacked inside a mold and a composite was produced with the application of a pressure of 7 kg/cm$^2$ at 120° C. for 40 minutes. The interlaminar shear strength of this composite was measured according to D-2344 of ASTM. The results are shown in Table 3.

Measurement of Particle Diameters (Size)

The diameters of emulsified or dispersed particles of water-based sizing agents prepared in Part (2) were measured by a particle size analyzer by laser diffraction/scattering method (LA-700 produced by Horiba Seisakusho, Co., Ltd.). The results are shown in Table 3.

Table 3 clearly shows that carbon fibers can be provided with lubricity, abrasion durability and spreadability at the same time according to this invention and that composites with superior physical properties can be obtained.

TABLE 3

| Example | Water-based sizing agent | Amount (%) | Lubricity F/Fμ | Lubricity F/Mμ | (*) (Point) | (**) (g) | (kg/mm$^2$) | ILSS Size (μm) |
|---|---|---|---|---|---|---|---|---|
| | | | Test Examples: | | | | | |
| 1 | S-1 | 1.0 | 0.22 | 0.20 | 4–5 | 1.5 | 8.3 | 0.19 |
| 2 | S-2 | 0.5 | 0.17 | 0.16 | 5 | 2.1 | 8.1 | 0.14 |
| 3 | S-2 | 2.0 | 0.16 | 0.15 | 5 | 2.0 | 8.0 | 0.14 |
| 4 | S-3 | 1.5 | 0.21 | 0.20 | 5 | 2.5 | 8.2 | 0.18 |
| 5 | S-4 | 1.5 | 0.20 | 0.19 | 5 | 2.1 | 8.1 | 0.17 |
| 6 | S-5 | 1.5 | 0.17 | 0.16 | 5 | 2.1 | 8.0 | 0.18 |
| 7 | S-6 | 1.5 | 0.20 | 0.19 | 5 | 2.2 | 8.2 | 0.19 |
| 8 | S-7 | 1.5 | 0.17 | 0.16 | 5 | 2.3 | 8.0 | 0.19 |
| | | | Comparison Examples: | | | | | |
| 1 | R-1 | 1.5 | 0.23 | 0.24 | 2–3 | 2.2 | 6.8 | 0.25 |
| 2 | R-2 | 1.5 | 0.21 | 0.20 | 3 | 2.2 | 7.0 | 0.20 |
| 3 | R-3 | 1.5 | 0.23 | 0.24 | 3–4 | 2.5 | 7.0 | 0.28 |
| 4 | R-4 | 1.5 | 0.23 | 0.21 | 2–3 | 2.2 | 6.9 | 0.20 |
| 5 | R-5 | 1.5 | 0.23 | 0.21 | 3 | 2.1 | 7.0 | 0.21 |
| 6 | R-6 | 1.5 | 0.24 | 0.25 | 3–4 | 2.6 | 7.0 | 0.28 |
| 7 | R-7 | 1.5 | 0.24 | 0.22 | 3 | 2.3 | 6.9 | 0.20 |
| 8 | R-8 | 1.5 | 0.24 | 0.22 | 2–3 | 2.2 | 7.0 | 0.21 |
| 9 | R-9 | 1.5 | 0.23 | 0.22 | 3 | 2.3 | 6.9 | 0.20 |
| 10 | R-10 | 1.5 | 0.22 | 0.23 | 3–4 | 2.4 | 7.0 | 0.28 |
| 11 | R-11 | 1.5 | 0.22 | 0.21 | 3 | 2.3 | 7.0 | 0.28 |
| 12 | R-12 | 1.5 | 0.22 | 0.20 | 3–4 | 2.3 | 7.3 | 0.26 |
| 13 | R-13 | 1.5 | 0.20 | 0.19 | 3 | 0.8 | 6.9 | 0.12 |
| 14 | R-14 | 1.5 | 0.28 | 0.30 | 2 | 2.3 | 7.1 | 0.27 |
| 15 | R-15 | 1.5 | 0.15 | 0.14 | 5 | 0.8 | 6.8 | 0.25 |
| 16 | S-1 | 0.02 | 0.32 | 0.35 | 1 | 2.0 | 7.3 | 0.22 |
| 17 | S-1 | 15.0 | 0.28 | 0.25 | 4–5 | 2.1 | 6.1 | 0.22 |

In Table 3:
"Amount": Amount of sizing agent attached to carbon fibers;
"(*)": Abrasion durability;
"(**)": Spreadability.

What is claimed is:

1. A method of sizing carbon fibers, said method comprising the steps of:

preparing a water-based sizing agent by emulsifying or dispersing in water a sizing agent comprising at least one ester and at least one polyepoxy compound having at least two epoxy groups at weight ratio of 2/98–16/84; and applying said water-based sizing agent to carbon fibers such that said sizing agent is attached to said carbon fibers at a rate of 0.1–5.0 weight % with respect to said carbon fibers;

said at least one ester being one or more selected from the group consisting of Group A, Group B and Group C;

said Group A consisting of esters obtained by esterifying completely aliphatic dihydric-hexahydric alcohol having 2–20 carbon atoms with aliphatic monocarboxylic acid having 6–26 carbon atoms and containing 50–95 molar % of aliphatic monoenic monocarboxylic acid;

said Group B consisting of esters obtained by esterifying completely aliphatic dihydric-hexahydric (poly) etherpolyol with aliphatic monocarboxylic acid having 6–26 carbon atoms and containing 50–95 molar % of aliphatic monoenic monocarboxylic acid; and said Group C consisting of esters obtained by esterifying completely aliphatic monohydric alcohol having 6–26 carbon atoms and containing 50–95 molar % of unsaturated aliphatic alcohol with aliphatic dicarboxylic-hexacarboxylic acid having 2–20 carbon atoms.

2. The method of claim 1 wherein said water-based sizing agent is formed by adding less than 45 weight parts of non-ionic surfactant to 100 weight parts of said sizing agent to emulsify or disperse in water, said non-ionic surfactant being at least one selected from the group consisting of polyoxyethylene phenylether having substituted phenol group by hydrocarbon group and formaldehyde condensate thereof.

3. The method of claim 2 wherein said Group A consists of esters obtained by esterifying completely aliphatic dihydric-hexahydric alcohol having 2–20 carbon atoms with aliphatic monocarboxylic acid having 6–26 carbon atoms and containing 60–90 molar % of aliphatic monoenic monocarboxylic acid.

4. The method of claim 2 wherein said Group B consists of esters obtained by esterifying completely aliphatic dihydric-hexahydric (poly)etherpolyol with aliphatic monocarboxylic acid having 6–26 carbon atoms and containing 60–90 molar % of aliphatic monoenic monocarboxylic acid.

5. The method of claim 2 wherein said Group C consists of esters obtained by esterifying completely aliphatic monohydric alcohol having 6–26 carbon atoms containing 60–90 molar % of unsaturated aliphatic alcohol with aliphatic dicarboxylic-hexacarboxylic acid having 2–20 carbon atoms.

6. The method of claim 2 wherein said at least one polyepoxy compound consists of at least one selected from the group consisting of bisphenol diglycidylether and polymethylene polyphenylglycidylether.

7. The method of claim 2 wherein said at least one polyepoxy compound consists of at least one selected from the group consisting of epoxydized polyalkadiene with 4–6 carbons.

8. The method of claim 1 wherein said at least one polyepoxy compound consists of at least one selected from the group consisting of epoxydized polyalkadiene with 4–6 carbons.

9. The method of claim 1 wherein said at least one polyepoxy compound consists of at least one selected from the group consisting of bisphenol diglycidylether and polymethylene polyphenylglycidylether.

* * * * *